US010975615B1

(12) United States Patent
Vega

(10) Patent No.: US 10,975,615 B1
(45) Date of Patent: Apr. 13, 2021

(54) GYM LOCKER ATTACHED PRIVACY COVER

(71) Applicant: Juanita Vega, Tulsa, OK (US)

(72) Inventor: Juanita Vega, Tulsa, OK (US)

( * ) Notice: Subject to any disclaimer, the term of this patent is extended or adjusted under 35 U.S.C. 154(b) by 276 days.

(21) Appl. No.: 16/208,664

(22) Filed: Dec. 4, 2018

(51) Int. Cl.

| | |
|---|---|
| ***E06B 9/24*** | (2006.01) |
| ***E04H 15/00*** | (2006.01) |
| ***A47G 5/02*** | (2006.01) |
| *E06B 9/40* | (2006.01) |
| *E04H 15/34* | (2006.01) |

(52) U.S. Cl.
CPC ..... *E06B 9/24* (2013.01); *A47G 5/02* (2013.01); *E04H 15/003* (2013.01); *E04H 15/005* (2013.01); *E04H 15/34* (2013.01); *E06B 2009/2482* (2013.01); *E06B 2009/2488* (2013.01); *E06B 2009/405* (2013.01)

(58) Field of Classification Search
CPC ..... A47B 97/00; E06B 2009/405; E06B 2009/2488; E06B 2009/2482; E06B 9/24; A47G 5/02; E04H 15/003; E04H 15/005; E04H 15/34
See application file for complete search history.

(56) References Cited

U.S. PATENT DOCUMENTS

| | | | | |
|---|---|---|---|---|
| 3,288,157 | A | 11/1966 | Szkolny | |
| 4,974,265 | A | 12/1990 | Maggio | |
| 5,287,909 | A | 2/1994 | King | |
| 6,497,268 | B1 * | 12/2002 | Peppett | A47F 5/01 160/374.1 |
| D648,837 | S | 11/2011 | Sulzer | |
| 9,784,008 | B1 | 10/2017 | Carolina | |
| 2005/0034748 | A1 | 2/2005 | Gadd | |
| 2005/0045284 | A1 * | 3/2005 | Ullyett | E06B 9/24 160/238 |
| 2006/0118252 | A1 * | 6/2006 | Kirby | E06B 9/42 160/262 |
| 2007/0193705 | A1 * | 8/2007 | Hsu | A47G 5/02 160/238 |
| 2012/0055639 | A1 * | 3/2012 | Maruyama | G03B 21/58 160/239 |
| 2012/0175065 | A1 * | 7/2012 | Mayzum | E06B 7/18 160/24 |

(Continued)

FOREIGN PATENT DOCUMENTS

| | | |
|---|---|---|
| WO | 2005017285 | 2/2005 |

*Primary Examiner* — Daniel P Cahn
*Assistant Examiner* — Matthew Richard Shepherd
(74) *Attorney, Agent, or Firm* — Kyle A. Fletcher, Esq.

(57) ABSTRACT

The gym locker attached privacy cover creates a privacy area behind an arched privacy screen where a user may change clothing without being seen. The gym locker attached privacy cover attaches to gym lockers at a first support column and a second support column. An opaque screen stored without the support columns is deployed from around spindles within each support column and wires in the opaque screen cause the opaque screen to form an arch that projects away from the lockers. The user may stand within the space defined between the lockers and the arch. The first support column and the second support column may each be held in place by a set of magnets. In some embodiments, the privacy screen may be retracted by a spring-loaded ratchet and pawl arrangement or by a manually operated knob attached to the spindle.

16 Claims, 7 Drawing Sheets

(56) References Cited

U.S. PATENT DOCUMENTS

| | | | | |
|---|---|---|---|---|
| 2012/0234503 | A1* | 9/2012 | Kandakai | A47G 5/00 160/84.04 |
| 2015/0047118 | A1 | 2/2015 | Bilyk, Jr. | |
| 2015/0083176 | A1 | 3/2015 | Douglass | |
| 2015/0316962 | A1* | 11/2015 | Howes | G03B 21/58 16/87.2 |
| 2016/0374484 | A1* | 12/2016 | Abernathy | E04H 15/005 160/351 |
| 2018/0016839 | A1* | 1/2018 | Jeong | E06B 9/08 |

* cited by examiner

GYM LOCKER ATTACHED PRIVACY COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of privacy screens, more specifically, a gym locker attached privacy cover.

SUMMARY OF INVENTION

The gym locker attached privacy cover creates a privacy area behind an arched privacy screen where a user may change clothing without being seen. The gym locker attached privacy cover attaches to gym lockers at a first support column and a second support column. An opaque screen stored without the support columns is deployed from around spindles within each support column and wires in the opaque screen cause the opaque screen to form an arch that projects away from the lockers. The user may stand within the space defined between the lockers and the arch. The first support column and the second support column may each be held in place by a set of magnets. In some embodiments, the privacy screen may be retracted by a spring-loaded ratchet and pawl arrangement or by a manually operated knob attached to the spindle.

An object of the invention is to define a privacy area behind an opaque screen coupled to lockers.

Another object of the invention is to provide a first support column and a second support column for storing the privacy screen and for coupling to the lockers.

A further object of the invention is to provide shaped wires to form an arch in the privacy screen.

Yet another object of the invention is to couple the first support column and the second support column to the lockers using magnets.

These together with additional objects, features and advantages of the gym locker attached privacy cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the gym locker attached privacy cover in detail, it is to be understood that the gym locker attached privacy cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gym locker attached privacy cover.

It is therefore important that the claims be regarded as including such equivalent construction insofar as they do not depart from the spirit and scope of the gym locker attached privacy cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
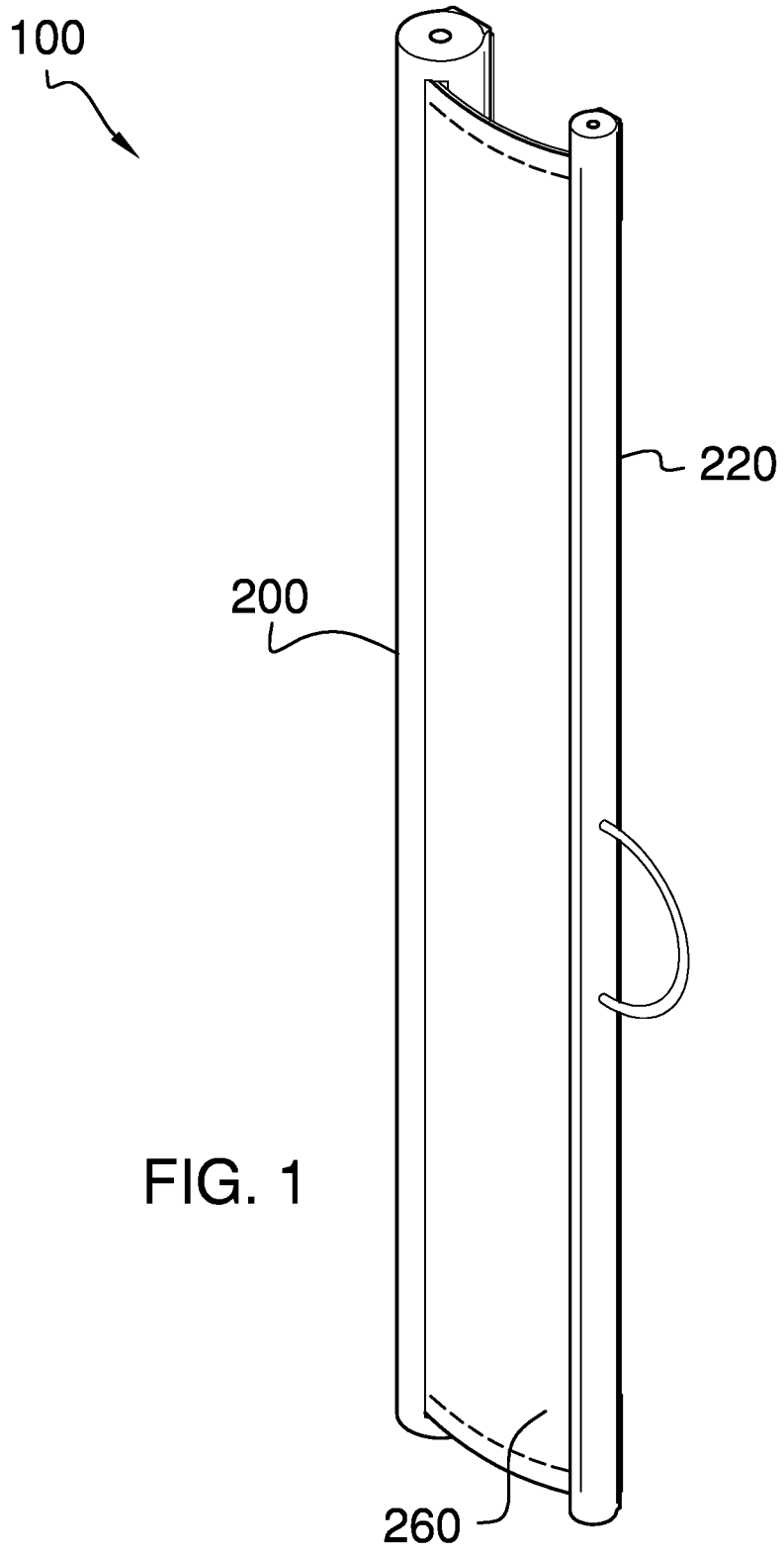
FIG. 1 is a perspective view of an embodiment of the disclosure.
Figure 2:
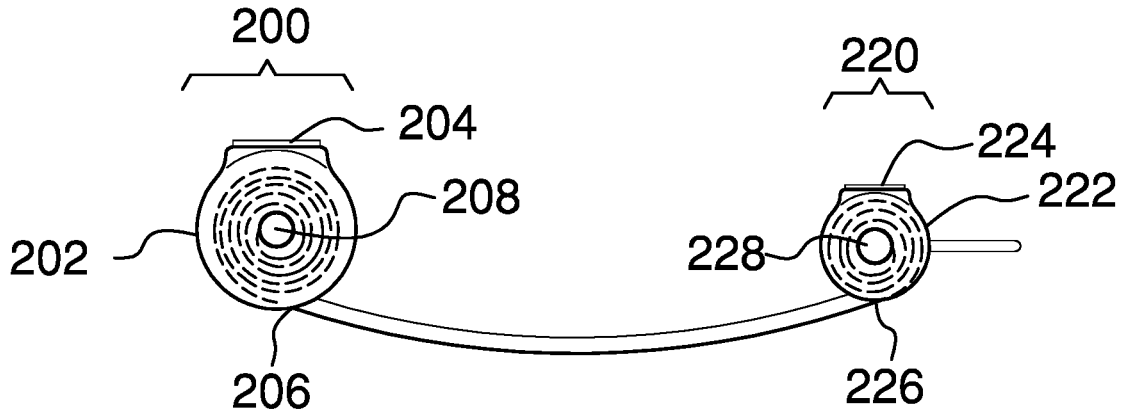
FIG. 2 is a top view of an embodiment of the disclosure.
Figure 3:
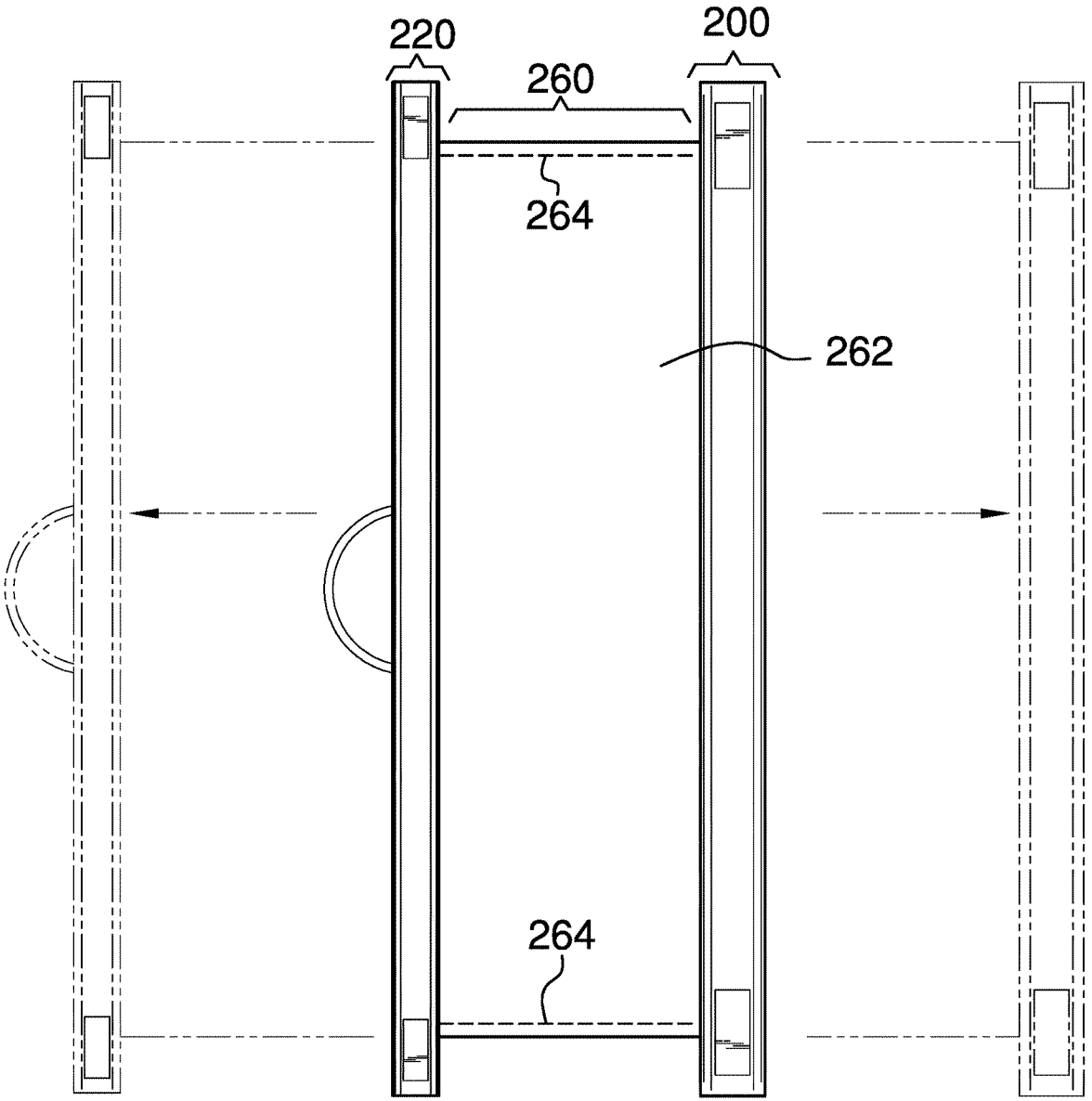
FIG. 3 is a rear view of an embodiment of the disclosure.
Figure 4:
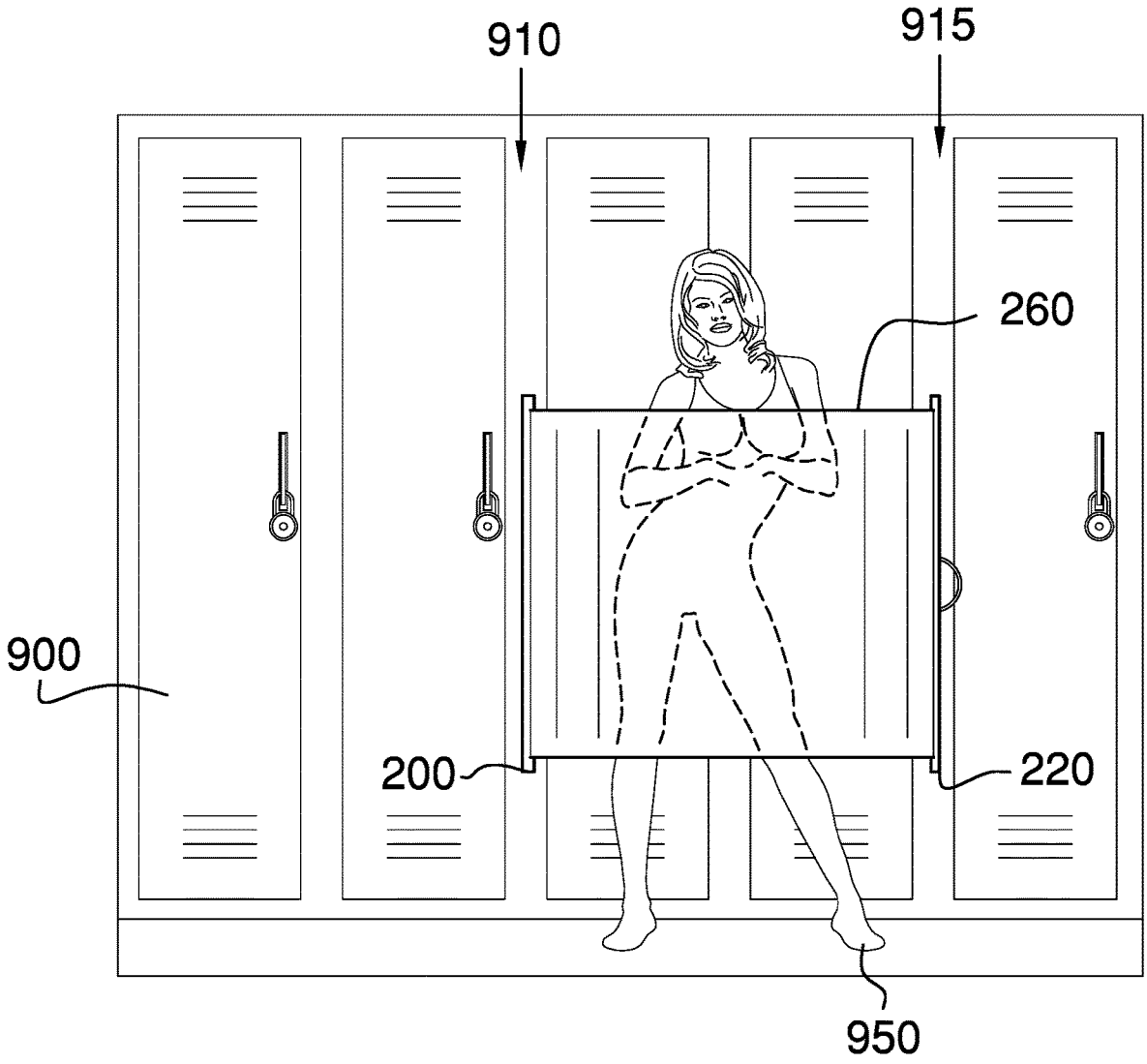
FIG. 4 is an in-use view of an embodiment of the disclosure.
Figure 5A:
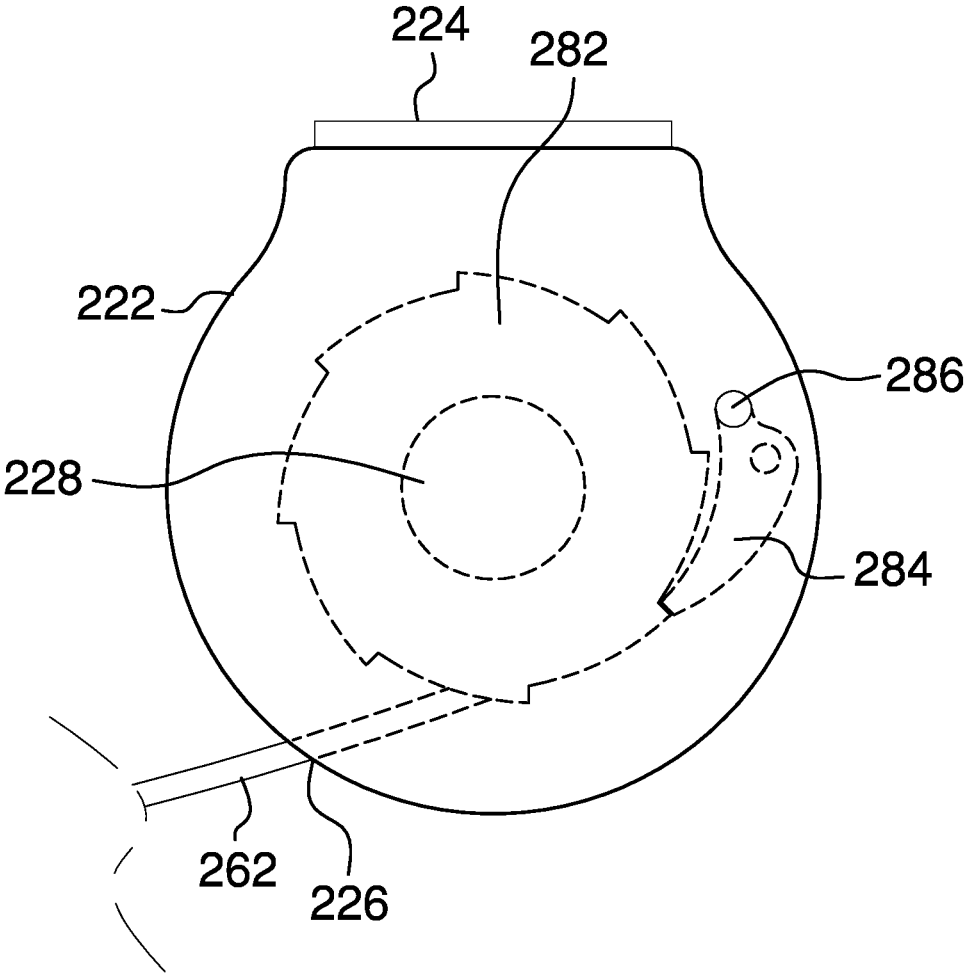
FIG. 5A is a detail view of an alternative embodiment of the disclosure illustrating a ratchet and pawl retractor at the top of the second support column as seen from above.
Figure 5B:
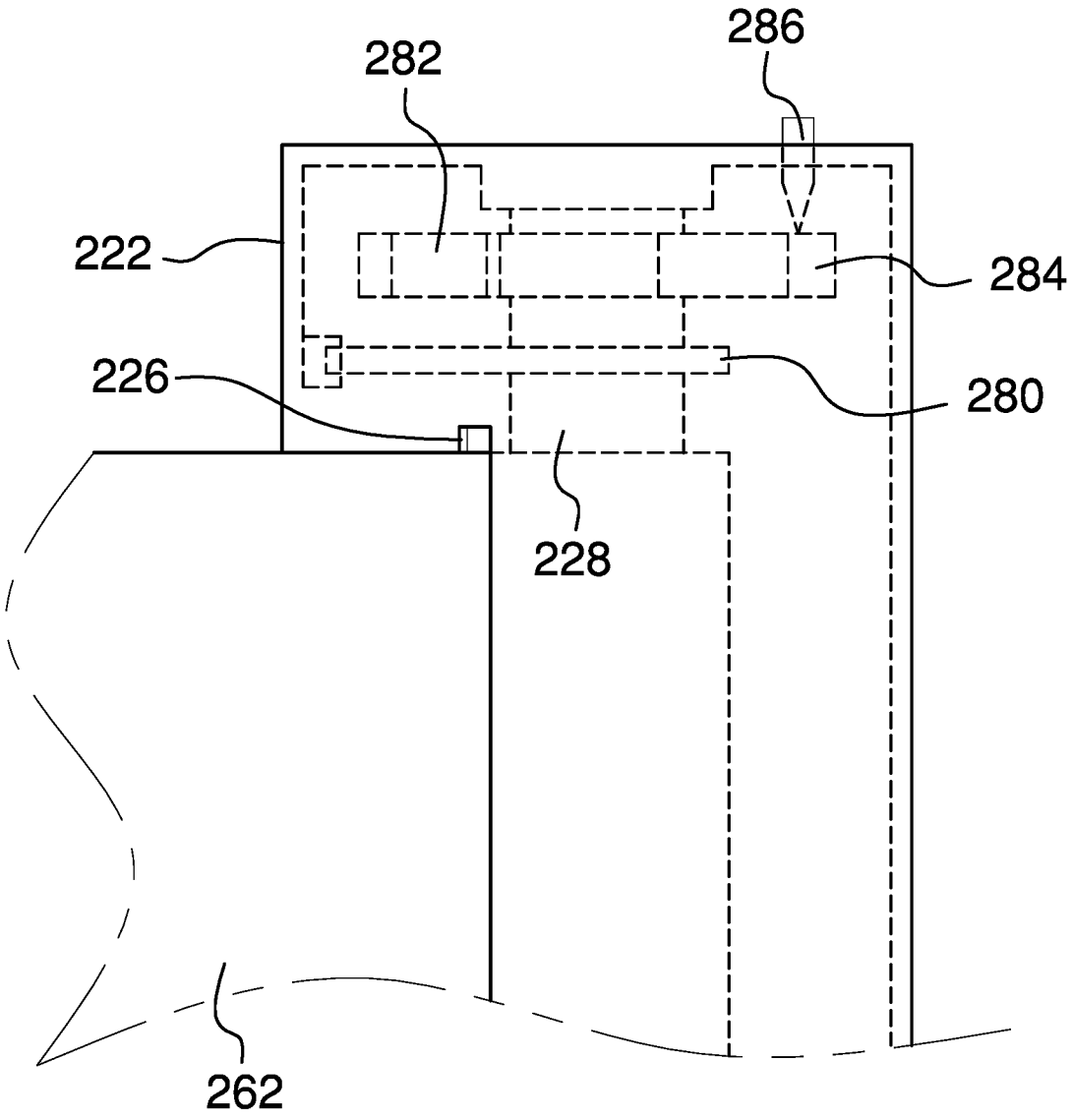
FIG. 5B is a detail view of an alternative embodiment of the disclosure illustrating a ratchet and pawl retractor at the top of the second support column as seen from the front.
Figure 6:
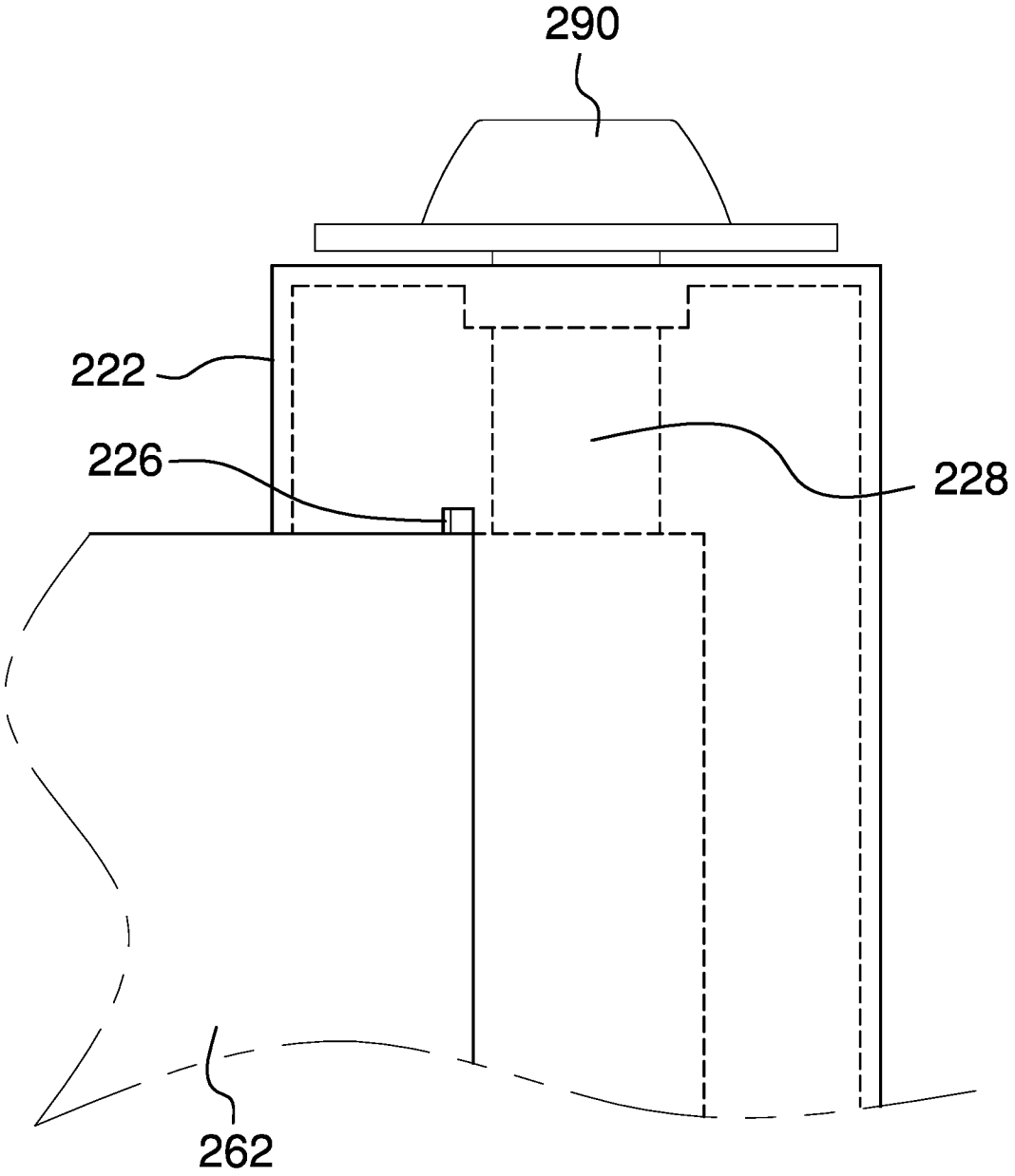
FIG. 6 is a detail view of an alternative embodiment of the disclosure illustrating a knob retractor at the top of the second support column as seen from the front.

Detailed reference will now be made to a first potential embodiment of the disclosure, which is illustrated in FIGS. 1 through 6.

The gym locker attached privacy cover 100 (hereinafter invention) comprises a first support column 200, a second support column 220, and a privacy screen 260. The privacy screen 260 may be adapted to arch away from a plurality of lockers 900 to create an area where a user 950 may stand behind the privacy screen 260 while changing clothing in a locker room. The privacy screen 260 may be held in place by the first support column 200 and the second support column 220 which attach to the plurality of lockers 900.

The first support column 200 comprises a first column housing 202, a first spindle 208, and a first magnet set 204. The first support column 200 may support and store one half of the privacy screen 260. The first support column 200 may be located on the left side of the privacy screen 260. The first support column 200 may be oriented such that the longitudinal axis of the first support column 200 is vertical. The first support column 200 may have a horizontal cross section that is circular.

The first column housing 202 may cover the outside of the first support column 200 to protect the privacy screen 260. The first column housing 202 may be composed of a rigid or semi-rigid material. The first column housing 202 may comprise a first screen slot 206. The first screen slot 206 may be vertically oriented. The privacy screen 260 may pass through the first screen slot 206.

The first spindle 208 may be located within the first support column 200. The first spindle 208 may be oriented such that the axis of rotation of the first spindle 208 is vertical. The first spindle 208 may be rotationally coupled to the top end and to the bottom end of the first support column 200 such that the first spindle 208 may rotate around a its longitudinal axis.

The first magnet set 204 may be located on the rear side of the first support column 200. The first magnet set 204 may comprise one or more magnets that may magnetically attach to the plurality of lockers 900 at a first mounting location 910.

The second support column 220 comprises a second column housing 222, a second spindle 228, and a second magnet set 224. The second support column 220 may support and store one half of the privacy screen 260. The second support column 220 may be located on the right side of the privacy screen 260. The second support column 220 may be oriented such that the longitudinal axis of the second support column 220 is vertical. The second support column 220 may have a horizontal cross section that is circular.

The second column housing 222 may cover the outside of the second support column 220 to protect the privacy screen 260. The second column housing 222 may be composed of a rigid or semi-rigid material. The second column housing 222 may comprise a second screen slot 226. The second screen slot 226 may be vertically oriented. The privacy screen 260 may pass through the second screen slot 226.

The second spindle 228 may be located within the second support column 220. The second spindle 228 may be oriented such that the axis of rotation of the second spindle 228 is vertical. The second spindle 228 may be rotationally coupled to the top end and to the bottom end of the second support column 220 such that the second spindle 228 may rotate around a its longitudinal axis.

The second magnet set 224 may be located on the rear side of the second support column 220. The second magnet set 224 may comprise one or more magnets that may magnetically attach to the plurality of lockers 900 at a second mounting location 915.

The privacy screen 260 comprises an opaque screen 262 and one or more shaping wires 264. The privacy screen 260 may be adapted to prevent viewing of the user 950 when the user 950 stands behind the privacy screen 260.

The opaque screen 262 may be a flexible sheet of an opaque material. The left edge of the opaque screen 262 may be coupled to the first spindle 208 in the first support column 200. The right edge of the opaque screen 262 may be coupled to the second spindle 228 in the second support column 220. The left side of the opaque screen 262 may be wrapped around the first spindle 208 for when not deployed. The right side of the opaque screen 262 may be wrapped around the second spindle 228 for when not deployed. When deployed, the opaque screen 262 may be unwrapped from the first spindle 208 and/or the second spindle 228, stretched between the first support column 200 and the second support column 220, and shaped by the one or more shaping wires 264.

The one or more shaping wires 264 may be semi-rigid support strands coupled to the surface of the opaque screen 262 or embedded within the opaque screen 262. The one or more shaping wires 264 may arch towards the front of the invention 100 such that the opaque screen 262 is pushed away from the plurality of lockers 900 when the invention 100 is deployed. The one or more shaping wires 264 may coil around the first spindle 208 and the second spindle 228 when the privacy screen 260 is retracted.

An individual support column selected from the first support column 200 or the second support column 220 may comprise a retraction mechanism. The retraction mechanism may retract the privacy screen 260 into the individual support column.

As a non-limiting example, the retraction mechanism may comprise a spring 280. One end of the spring 280 may be coupled to an individual spindle selected from the first spindle 208 or the second spindle 228. The other end of the spring 280 may be coupled to an individual column housing selected from the first column housing 202 or the second column housing 222. The spring 280 may store energy when the privacy screen 260 is pulled out of the individual support column. A ratchet 282 within the individual support column may allow the individual spindle to turn as the privacy screen 260 is being pulled from the individual support column. A pawl 284 within the individual support column may prevent the individual spindle from turning in the opposite direction unless a release button 286 on the top of the individual support column is pressed. When the release button 286 is pressed, the energy stored in the spring 280 may act to pull the privacy screen 260 into the individual support column.

As a non-limiting example, the retraction mechanism may comprise a knob 290 coupled to the top of the individual spindle selected from the first spindle 208 or the second spindle 228. The knob 290 may be turned manually to retract the privacy screen 260 into the individual support column.

In use, the first support column 200 may be magnetically mounted to the plurality of lockers 900 at the first mounting location 910 and the second support column 220 may be magnetically mounted to the plurality of lockers 900 at the second mounting location 915 where the first mounting location 910 is to the left of the second mounting location 915. As the first support column 200 is separated from the second support column 220, the privacy screen 260 is withdrawn from the first support column 200 and from the second support column 220 and the one or more shaping wires 264 shape the opaque screen 262 into an arch projecting away from the plurality of lockers 900. The first support column 200 and the second support column 220 may be mounted at a height such that the privacy screen 260 obscures the view of the waist and chest of the user 950 standing behind the privacy screen 260. The user 950 may stand within the area defined by the arch of the privacy screen 260 and may change clothing with privacy provided by the invention 100. When no longer needed, the first support column 200 and the second support column 220 may be removed from the plurality of lockers 900 and the retraction mechanisms may be used to retract the privacy screen 260 back into the first support column 200 and the second support column 220.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, the words "couple", "couples", "coupled" or "coupling", refer to connecting, either directly or indirectly, and does not necessarily imply a mechanical connection.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, "horizontal" is a directional term that refers to a direction that is perpendicular to the local force of gravity. Unless specifically noted in this disclosure, the horizontal direction is always perpendicular to the vertical direction.

As used herein, the word "longitudinal" or "longitudinally" refers to a lengthwise or longest direction.

As used in this disclosure, a "magnet" is an ore, alloy, or other material that has its component atoms arranged so the material exhibits properties of magnetism such as attracting iron-containing objects or aligning itself in an external magnetic field.

As used in this disclosure, "opaque" refers to an object or material that prevents the passage of light and/or other forms of radiations through the object or material.

As used in this disclosure, a "ratchet" is a device comprising a pawl or hinged catch that engages the sloping teeth of a wheel or bar permitting motion in one direction only. A "ratcheting mechanism" is a device that incorporates a ratchet. "Ratcheting motion" refers to motion along a ratcheting mechanism.

As used in this disclosure, "resilient" or "semi-rigid" refer to an object or material which will deform when a force is applied to it and which will return to its original shape when the deforming force is removed.

As used herein, "rigid" refers to an object or material which is inflexible. If a force is applied to a rigid object the rigid object does not bend or deform unless the force applied reaches the breaking point of the rigid object.

As used in this disclosure, a "slot" is a long narrow groove, cut, opening, or aperture that is formed in or through an object.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A gym locker attached privacy cover comprising:

a first support column, a second support column, and an opaque privacy screen;

wherein the privacy screen is adapted to arch away from a plurality of lockers to create an area where a user stands behind the privacy screen while changing clothing in a locker room;

wherein the privacy screen is configured to be held in place by the first support column and the second support column which attach to the plurality of lockers;

wherein the first support column comprises a first column housing, a first spindle, and a first magnet set;

wherein the first support column supports and stores one half of the privacy screen;

wherein the first support column is located on the left side of the privacy screen;

wherein the second support column comprises a second column housing, a second spindle, and a second magnet set;

wherein the second support column supports and stores one half of the privacy screen;

wherein the second support column is located on the right side of the privacy screen;

wherein one or more shaping wires are semi-rigid support strands coupled to a surface of the opaque screen or embedded within the opaque screen; wherein the one or more shaping wires arch towards a front of the gym locker attached privacy cover such that the opaque screen is arched away from the plurality of lockers when the gym locker attached privacy cover is deployed;

wherein the one or more shaping wires coil around the first spindle and the second spindle when the privacy screen is retracted.

2. The gym locker attached privacy cover according to claim 1 wherein the first support column is oriented such that a longitudinal axis of the first support column is vertical;

wherein the first support column has a horizontal cross section that is circular.

3. The gym locker attached privacy cover according to claim 2 wherein the first column housing covers the outside of the first support column to protect the privacy screen;

wherein the first column housing is composed of a rigid or semi-rigid material.

4. The gym locker attached privacy cover according to claim 3 wherein the first column housing comprises a first screen slot;

wherein the first screen slot is vertically oriented;

wherein the privacy screen passes through the first screen slot.

5. The gym locker attached privacy cover according to claim 4 wherein the first spindle is located within the first support column;

wherein the first spindle is oriented such that an axis of rotation of the first spindle is vertical;

wherein the first spindle is rotationally coupled a top end and to a bottom end of the first support column such that the first spindle rotates around its longitudinal axis.

6. The gym locker attached privacy cover according to claim 5 wherein the first magnet set is located on a rear side of the first support column;

wherein the first magnet set comprises one or more magnets that magnetically attach to the plurality of lockers at a first mounting location.

7. The gym locker attached privacy cover according to claim 6 wherein the second support column is oriented such that a longitudinal axis of the second support column is vertical;

wherein the second support column has a horizontal cross section that is circular.

8. The gym locker attached privacy cover according to claim 7 wherein the second column housing covers the outside of the second support column to protect the privacy screen;

wherein the second column housing is composed of a rigid or semi-rigid material.

9. The gym locker attached privacy cover according to claim 8 wherein the second column housing comprises a second screen slot;

wherein the second screen slot is vertically oriented;

wherein the privacy screen passes through the second screen slot.

10. The gym locker attached privacy cover according to claim 9 wherein the second spindle is located within the second support column;

wherein the second spindle is oriented such that an axis of rotation of the second spindle is vertical;

wherein the second spindle is rotationally coupled to a top end and to a bottom end of the second support column such that the second spindle rotates around its longitudinal axis.

11. The gym locker attached privacy cover according to claim 10 wherein the second magnet set is located on a rear side of the second support column;

wherein the second magnet set comprises one or more magnets that magnetically attach to the plurality of lockers at a second mounting location.

12. The gym locker attached privacy cover according to claim 11 wherein the privacy screen is adapted to prevent viewing of the user when the user stands behind the privacy screen.

13. The gym locker attached privacy cover according to claim 12 wherein the opaque screen is a flexible sheet of an opaque material;

wherein a left edge of the opaque screen is coupled to the first spindle in the first support column;

wherein a right edge of the opaque screen is coupled to the second spindle in the second support column;

wherein the left side of the opaque screen is wrapped around the first spindle for when not deployed;

wherein the right side of the opaque screen is wrapped around the second spindle for when not deployed;

wherein when deployed, the opaque screen is unwrapped from the first spindle and/or the second spindle, stretched between the first support column and the second support column, and shaped by the one or more shaping wires.

14. The gym locker attached privacy cover according to claim 13 wherein an individual support column selected from the first support column or the second support column comprises a retraction mechanism;

wherein the retraction mechanism retracts the privacy screen into the individual support column.

15. The gym locker attached privacy cover according to claim 14 wherein the retraction mechanism comprises a spring;

wherein one end of the spring is coupled to an individual spindle selected from the first spindle or the second spindle;

wherein the other end of the spring is coupled to an individual column housing selected from the first column housing or the second column housing;

wherein the spring stores energy when the privacy screen is pulled out of the individual support column;

wherein a ratchet within the individual support column allows the individual spindle to turn as the privacy screen is being pulled from the individual support column;

wherein a pawl within the individual support column prevents the individual spindle from turning in the opposite direction unless a release button on a top of the individual support column is pressed;

wherein when the release button is pressed, the energy stored in the spring acts to pull the privacy screen into the individual support column.

16. The gym locker attached privacy cover according to claim 14 wherein the retraction mechanism comprises a knob coupled to the top of the individual spindle selected from the first spindle or the second spindle;

wherein the knob is turned manually to retract the privacy screen into the individual support column.

* * * * *